United States Patent [19]

Wakeman et al.

[11] Patent Number: 4,930,465

[45] Date of Patent: Jun. 5, 1990

[54] SOLENOID CONTROL OF ENGINE VALVES WITH ACCUMULATOR PRESSURE RECOVERY

[75] Inventors: Russell J. Wakeman; Stephen F. Shea, both of Newport News, Va.

[73] Assignee: Siemens-Bendix Automotive Electronics L.P., Troy, Mich.

[21] Appl. No.: 416,339

[22] Filed: Oct. 3, 1989

[51] Int. Cl.[5] ..... F01L 9/02; F01L 1/34

[52] U.S. Cl. ..... 123/90.12; 123/90.16

[58] Field of Search ..... 123/90.11, 90.12, 90.13, 123/90.16

[56] References Cited

U.S. PATENT DOCUMENTS

| | | | |
|---|---|---|---|
| 4,408,580 | 10/1983 | Kosuda et al. | 123/90.16 |
| 4,466,390 | 8/1984 | Babitzka et al. | 123/90.12 |
| 4,502,425 | 3/1985 | Wride | 123/90.16 |
| 4,615,306 | 10/1986 | Wakeman | 123/90.46 |
| 4,671,221 | 6/1987 | Geringer et al. | 123/90.12 |
| 4,674,451 | 6/1987 | Rembold et al. | 123/90.12 |
| 4,696,265 | 9/1987 | Nohira | 123/90.12 |
| 4,716,863 | 1/1988 | Pruzan | 123/90.12 |
| 4,791,895 | 12/1988 | Tittizer | 123/90.11 |
| 4,796,573 | 1/1989 | Wakeman et al. | 123/90.16 |

FOREIGN PATENT DOCUMENTS

| | | | |
|---|---|---|---|
| 3347533 | 7/1985 | Fed. Rep. of Germany | 123/90.13 |

*Primary Examiner*—Charles J. Myhre
*Assistant Examiner*—Weilun Lo
*Attorney, Agent, or Firm*—George L. Boller; Russel C. Wells

[57] ABSTRACT

A system for accomplishing solenoid control of engine valves places a soldnoid valve between an oil gallery and the lost-motion actuator for each valve. Although the basic phasing for the valves is established by a camshaft, the actual phasing is accomplished by causing the valve actuators to execute lost-motion. The amount of lost-motion establishes the actual opening and closing phase angles for the valves. The amount of lost-motion of each actuator is established by the timing of the opening and closing of the corresponding solenoid valve. Oil that is pumped from the actuators can be stored in an accumulator that is connected to the gallery for subsequent use in replenishing the actuators.

7 Claims, 2 Drawing Sheets

SOLENOID CONTROL OF ENGINE VALVES WITH ACCUMULATOR PRESSURE RECOVERY

BACKGROUND AND SUMMARY OF THE INVENTION

This invention relates to the operation of the valves of an internal combustion engine, particularly control of the phase angles at which the valves open and close.

It is generally known that improvements in engine operation are attainable by modulation of the phase angles at which engine valves open and close. Such control is applicable to both the intake and exhaust valves although for any of a number of different reasons the control of only one type of valves may be implimented in a given engine.

One known means for effectuating valve control is by employing a "lost-motion" type actuator between a camshaft and each valve. Since the throw of each lobe of the camshaft is fixed, the camshaft will open and close each valve at fixed opening and closing phase angles if there is no lost-motion in the mechanisms between the lobes and the valves. The inclusion of a lost-motion actuator in the mechanism between the camshaft and each valve allows some of the motion that is generated by the camshaft to be taken up by the actuator with the result that the opening phase angle of the valve can be retarded and the closing phase angle advanced from the fixed phase angles that would otherwise exist in the absence of the lost-motion.

U.S. Pats. 4,615,306 and 4,796,573 disclose lost-motion valve control systems in which the lost-motion actuators are extended and contracted in length by the introduction and exhaustion of hydraulic fluid. The engine's lubrication system is used as the source of hydraulic fluid with the fluid being engine lubricant, i.e. oil. The oil that is discharged from one actuator is routed to a common gallery for recovery and subsequent use by other actuators so that the load on the engine's lubrication system is kept to a minimum. In order to keep cost low, previous systems such as that of U.S. Pat. 4,615,306 have employed solenoid valves shared by actuators and using a system of check valves to insure that the solenoid has control of each valve as it becomes active.

As an actuator contracts, the hydraulic pressure pulse that it generates can contribute to expanding an inactive actuator so that high response rates can be achieved. If an actuator can be kept in contact with the valvetrain at all times, the response rate can be as high as the cycle rate of the camshaft. Moreover, by keeping an actuator in contact with the valvetrain at all times, durability issues arising from impacting of parts against each other are essentially eliminated.

Previous systems with shared solenoids have used the pressure pulse from a contracting actuator for actuator re-extension, but the timing of the pressure pulse was not under the control of the solenoid since refilling was done through the check valves.

The present invention contemplates the use of a solenoid valve as the sole fluid path to and from an actuator so that timing of the refilling part of the cycle can be controlled by the ECU (engine electronic control unit). The solenoid valve control envisioned by the invention can also be used to prevent a pressure pulse from entering an already expanded actuator, which might allow the engine valve to be momentarily lifted from its seat thereby possibly causing cylinder leakage and/or valve or valve seat damage.

Since the pressure pulses in an engine with a small number of cylinders may not overlap with the refill time in adjacent cylinders, particularly at low engine speeds, some means of storing pressurized hydraulic fluid is desirable. An accumulator connected to the gallery that is common to all solenoid valve outlets can store the fluid until the time is right to refill an actuator. In this way, with all solenoid valves closed and the check valve back to the lubrication system closed, pressurized fluid is trapped until one of the solenoid valves opens. Previous systems (U.S. Pat. 4,671,221) used accumulators for such purposes, but were costly because they had one accumulator per engine valve and lacked solenoid control of the refill cycle since there was a check valve path from the accumulator back to the actuator.

Other advantages of the invention include the elimination of multiple check valves, with some reliability benefits in the reduction of leakage paths and the elimination of possible wear points. The individual solenoids are also vastly more consistent and repeatable than ordinary check valves, and of much higher response time. While it might be possible to design check valves that might be repeatable, fast, and reliable enough, it seems that their cost would likely exceed that of the solenoid valves.

The foregoing features, advantages, and benefits of the invention, along with additional ones, will be seen in the ensuing description and claims, which should be considered in conjunction with the accompanying drawings. The drawings disclose a presently preferred embodiment of the invention in accordance with the best mode contemplated at the present time in carrying out the invention.

DESCRIPTION OF THE PREFERRED EMBODIMENT

Figure 1:
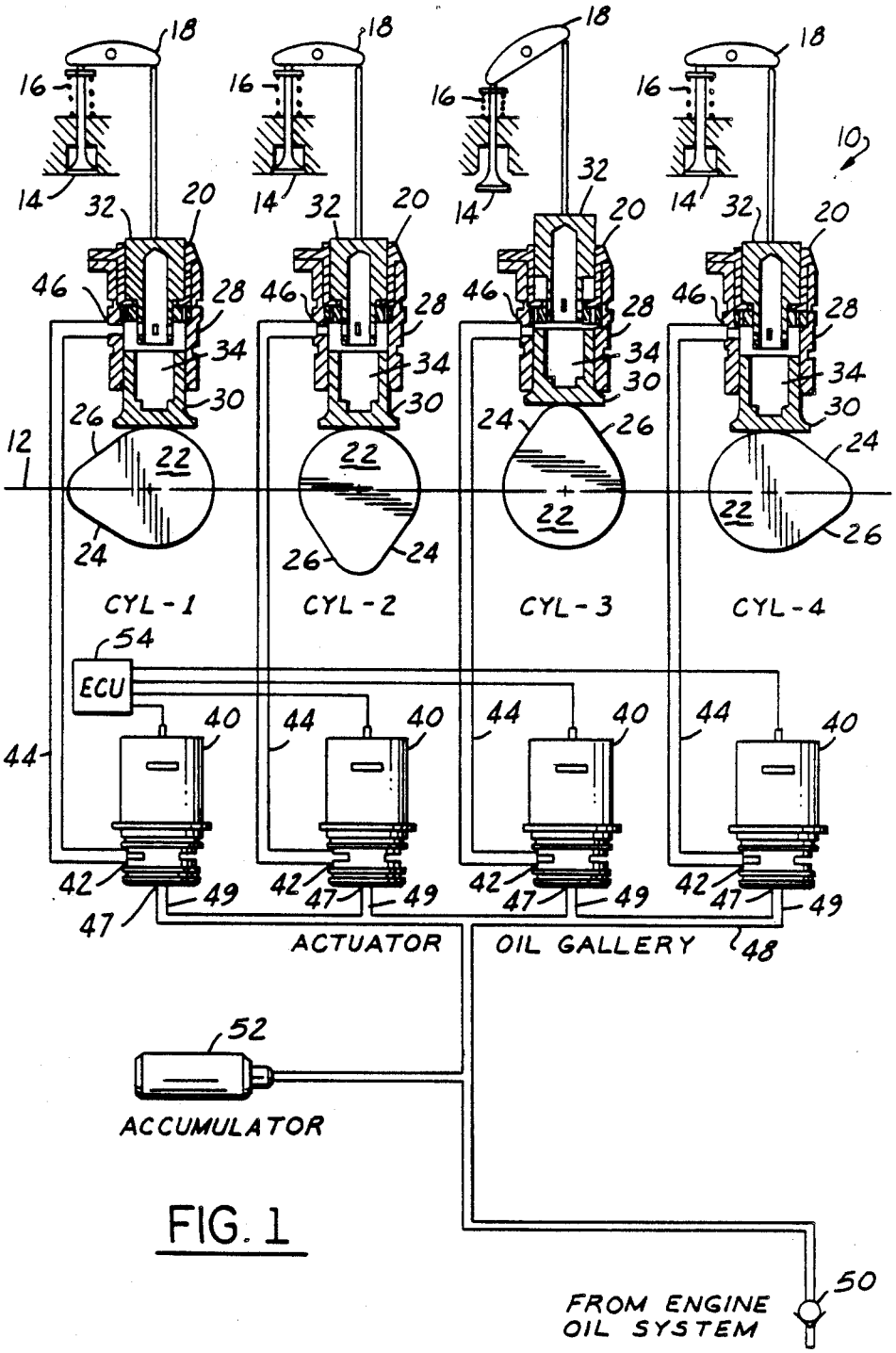
FIG. 1 is a schematic diagram illustrating a system embodying principles of the invention.

FIG. 1 illustrates, by way of example, a four cylinder internal combustion engine 10 that has a camshaft 12 that operates valves 14. For purposes of illustrating principles of the invention, the valves may be considered as intake valves, each of which is opened in timed relation to engine crankshaft rotation to communicate the corresponding combustion chamber to a source of combustible mixture. A helical spring 16 biases each valve 14 to close the corresponding combustion chamber.

A mechanism 18 couples camshaft 12 with each valve 14. Each mechanism includes a "lost-motion" type actuator 20 through which motion of the rising portion 24 of a corresponding lobe 22 of camshaft 12 is transmitted to the corresponding valve 14 when the actuator is being operated in the valve opening direction. When the falling portion 26 of the lobe encounters the actuator, the bias of spring 16 closes the valve while maintaining contact between the actuator and the cam lobe whereby the closing motion of the valve is controlled by the cam lobe.

Each actuator 20 comprises a body 28 that is fixedly mounted on engine 10. Two pistons 30, 32 are arranged for co-linear reciprocal motion on body 28 in the valve opening and valve closing directions. One piston 30 bears against the periphery of the corresponding cam lobe 22 while the other piston 32 is coupled to the corresponding valve 14.

Figure 3:
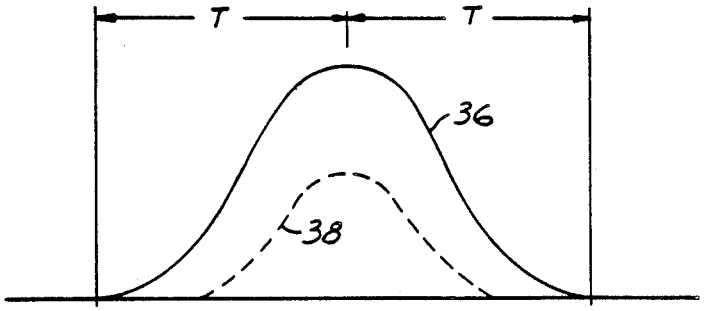
FIG. 3 is a diagram useful in explaining how the phase angles of engine valve opening and closing are varied by the system of Fig. 1.

The two pistons 30, 32 of each actuator 20 cooperate with the body 28 in forming a variable volume internal hydraulic chamber space 34. This chamber space is expansible and contractible to cause the effective length of the actuator, i.e. the distance between the two pistons 30, 32, to increase and decrease. As long as the volume of the chamber space 34 does not change, the full throw of the corresponding cam lobe is transmitted through the corresponding mechanism 18 to the corresponding valve. In this case, the phase angles at which the valve opens and closes the corresponding combustion chamber are fixed by the profile of the mechanical cam lobe. Such a mode of operation is represented by the waveform 36 in FIG. 3.

By decreasing the effective length of an actuator during the time that its piston 30 is being operated in the direction of valve opening, particularly during initial displacement of piston 30 in the direction of valve opening, the phase angle at which the engine valve opens can be retarded. The amount of retardation is a function of the extent to which the effective length of the actuator is decreased. The greater the decrease, the greater the retardation.

A decrease in the effective length of an actuator also produces a corresponding advance in the phase angle of the closing of the engine valve. A representative effect of decreasing the effective length of an actuator is portrayed by the waveform 38 in FIG. 3.

Control of the effective length of each actuator is accomplished in accordance with principles of the invention by means of a solenoid valve 40 for each actuator. One port 42 of each valve 40 is connected by a fluid line 44 to a port 46 in body 28 of the corresponding actuator 20. The other port 47 of each valve 40 is connected to a gallery 48 by a line 49. Hydraulic fluid, particularly engine oil from the engine lubrication system, is supplied to gallery 48 through a check valve 50. A hydraulic accumulator 52 is associated with gallery 48. When the solenoid of each valve 40 is energized, the normally closed flow path through the solenoid valve is open, and oil can flow between the corresponding actuator 20 and gallery 48 to supply and spill the chamber space 34, the direction of flow being a function of whether the pressure in the gallery is higher or lower than the pressure in the chamber space 34 of the actuator.

Figure 2:
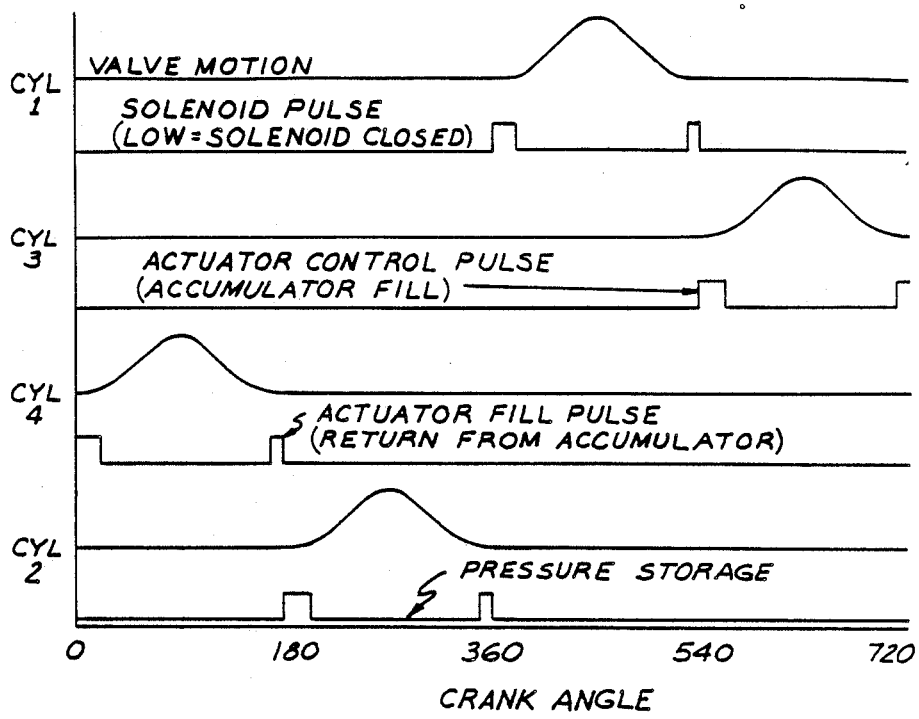
FIG. 2 is a timing diagram of waveforms illustrating engine valve motion and solenoid valve actuation for each cylinder of a four cylinder internal combustion engine.

Each solenoid is under the control of the ECU 54. FIG. 2 illustrates representative waveforms of valve motion and solenoid actuation for each of the four combustion chamber cylinders for a condition where there is a slight delay and a slight advance for valve opening and closing. By having each solenoid valve open during an initial portion of the time that the rising portion 24 of each cam lobe is acting upon the corresponding piston 30, hydraulic fluid is pumped from the corresponding chamber space, through the corresponding solenoid valve to the gallery, and no motion is imparted to piston 32. It is during this time that the effective length of the actuator is being contracted.

When the solenoid valve is de-energized, it closes to prevent further flow from the actuator chamber space to the gallery. As a consequence, the motion that is being imparted to piston 30 is now transmitted to displace piston 32 and in turn open valve 14. It is during this time that the effective length of the actuator is constant.

As the falling portion 26 of the lobe encounters piston 30, spring 16 is effective to urge the valve closed while at the same time causing pistons 30 and 32 to be displaced in the valve closing direction, with piston 30 being maintained in contact with the cam lobe. The effective length of the actuator remains constant during this time.

When the engine valve has closed, displacement of piston 32 ceases. So that piston 30 can however continue to ride on the cam lobe, solenoid valve 40 is opened, causing fluid to be pumped from gallery 48 into the now-expanding chamber space 34 of the actuator, and increasing the effective length of the actuator. This continues until the falling portion of the cam lobe ceases to act upon piston 30, and it is at this time that the solenoid valve is again closed.

The foregoing sequence of events is repeated for each valve while phasing is occurring. The extent of phasing is under the control of ECU 54, and is established according to a schedule that is programmed into the ECU. Since the ECU receives a crankshaft position signal from a pick-up, it will be able to calculate the time T, shown in FIG. 3, for any particular engine speed and desired valve opening and closing phase angles so that the solenoid valves are operated at the proper times to produce the desired phasing.

One of the advantages of the invention is that after an engine valve has closed, the isolation that is provided by the corresponding solenoid valve 40 prevents any pressure pulses from re-opening the engine valve when it should not be open. Another of the advantages is that the accumulator can store pressurized fluid and make that fluid subsequently available. Once the engine is running, the added load on the engine lubrication system is only that which is needed to replenish lost oil through check valve 50.

While a preferred embodiment of the invention has been disclosed and described, it should be appreciated that principles are applicable to other embodiments.

What is claimed is:

1. In an internal combustion engine having multiple combustion chambers and for each combustion chamber a corresponding engine valve for opening and closing the corrresponding combustion chamber during operation of the engine, for each of said valves a corresponding biasing means that biases the valve to close the corresponding combustion chamber, and means for operating each of said valves against the corresponding biasing means to repeatedly intermittently open the corresponding combustion chamber during engine operation, said means for operating each valve including for each valve a corresponding actuator that executes reciprocal motion along a corresponding linear axis, and means for varying the opening and closing phase angles of each valve comprising each of said actuators having means to vary the actuator's effective length by the selective pumping of hydraulic fluid into and out of an expansible and contractible interior hydraulic chamber space of the actuator to respectively expand and contract the volume of the chamber space, the improvement comprising for each actuator a corresponding solenoid valve that is selectively operable to open and close the communication of the corresponding actuator's interior hydraulic chamber space to a hydraulic gallery that commonly serves all solenoid valves, and means for selectively operating each solenoid valve such that both increases and decreases in the effective length of each actuator are controlled by the corresponding solenoid valve conducting hydraulic fluid supply and spill between the chamber space of the actuator and the hydraulic gallery through the solenoid valve.

2. The improvement set forth in claim 1 wherein the interior hydraulic chamber space of each actuator is cooperatively defined by a main body that is fixedly mounted on the engine and first and second pistons that are independently displaceable on said main body in directions of engine valve opening and engine valve closing, said means for selectively operating each solenoid valve such that both increases and decreases in the effective length of each actuator are controlled by the corresponding solenoid valve conducting hydraulic fluid flow between the chamber space of the actuator and the hydraulic gallery comprises means for opening each solenoid valve during an initial portion of the displacement of the first piston of the corresponding actuator in the direction of engine valve opening to cause fluid to be pumped from the actuator through the solenoid valve to the gallery and the second piston not to be displaced on said body, means for closing the solenoid valve after a certain amount of displacement of the first piston on the body has occurred in the direction of engine valve opening to cause fluid no longer to be pumped from the actuator and the second piston to now be displaced on the body until displacement of the first piston in the direction of engine valve opening has ceased, means for keeping the solenoid valve closed during displacement of the second piston in the direction of engine valve closing as the engine valve operates in the direction of closing to continue the interruption of fluid flow from the actuator to the gallery and displace the first piston on the body in the direction of engine valve closing, and means for opening the solenoid valve upon the engine valve closing the corresponding cylinder to cause fluid to now be pumped from the gallery through the solenoid valve into the actuator and displace the first piston on the body to a starting position from which it will subsequently be displaced on the body in the direction of engine valve opening, and means for closing the solenoid valve after the arrival of the first piston in said starting position until displacement of the first piston on the body from said starting position in the direction of engine valve opening subsequently ensues.

3. The improvement set forth in claim 1 including an accumulator that is associated with said gallery to accumulate excess hydraulic fluid pumped from any actuator and to replenish any actuator needing hydraulic fluid.

4. The improvement set forth in claim in which said means for operating each engine valve also comprises a rotary camshaft having multiple lobes, one for each engine valve, each lobe acting on the first piston of the corresponding actuator to cause the first piston to be displaced in the direction of engine valve opening, the first piston being maintained in contact with the lobe during engine valve closing, first by the corresponding biasing means acting via the corresponding engine valve and second piston, and then by the pumping of hydraulic fluid from the gallery into the actuator.

5. In an internal combustion engine having multiple combustion chambers and for each combustion chamber a corresponding engine valve for opening and closing the corrresponding combustion chamber during operation of the engine, and means for operating said valves at opening and closing phase angles that can be varied, said means comprising a camshaft that establishes for each valve fixed opening and closing phases angles and a lost-motion actuator between each valve and the camshaft, each actuator comprising an expansible and contractible interior hydraulic chamber space that is expanded and contracted to control the amount of lost-motion of the actuator and thereby vary the opening and closing phase angles of the corresponding valve from the fixed opening and closing phase angles that are established by the camshaft, the improvement comprising for each actuator a corresponding solenoid valve that is selectively operable to open and close the communication of the corresponding actuator's interior hydraulic chamber space to a hydraulic gallery that commonly serves all solenoid valves, and means for selectively operating each solenoid valve such that both expansion and contraction of the interior hydraulic chamber space of each actuator are controlled by the corresponding solenoid valve conducting hydraulic fluid supply and spill between the chamber space of the actuator and the hydraulic gallery through the solenoid valve.

6. The improvement set forth in claim 5 wherein the interior hydraulic chamber space of each actuator is cooperatively defined by a main body that is fixedly mounted on the engine and first and second pistons that are independently displaceable on said main body in directions of engine valve opening and engine valve closing, said means for selectively operating each solenoid valve such that both increases and decreases in the expansion and contraction of the interior hydraulic chamber space of each actuator are controlled by the corresponding solenoid valve conducting hydraulic fluid flow between the chamber space of the actuator and the hydraulic gallery comprises means for opening each solenoid valve during an initial portion of the displacement of the first piston of the corresponding actuator in the direction of engine valve opening to cause fluid to be pumped from the actuator through the solenoid valve to the gallery and the second piston not to be displaced on said body, means for closing the solenoid valve after a certain amount of displacement of the first piston on the body has occurred in the direction of engine valve opening to cause fluid no longer to be pumped from the actuator and the second piston to now be displaced on the body until displacement of the first piston in the direction of engine valve opening has ceased, means for keeping the solenoid valve closed during displacement of the second piston in the direction of engine valve closing as the engine valve operates in the direction of closing to continue the interruption of fluid flow from the actuator to the gallery and displace the first piston on the body in the direction of engine valve closing, and means for opening the solenoid valve upon the engine valve closing the corresponding cylinder to cause fluid to now be pumped from the gallery through the solenoid valve into the actuator and displace the first piston on the body to a starting position from which it will subsequently be displaced on the body in the direction of engine valve opening, and means for closing the solenoid valve after the arrival of the first piston in said starting position until displacement of the first piston on the body from said starting position in the direction of engine valve opening subsequently ensues.

7. The improvement set forth in claim 5 including an accumulator that is associated with said gallery to accumulate excess hydraulic fluid pumped from any actuator and to replenish any actuator needing hydraulic fluid.

* * * * *